US008087503B2

(12) United States Patent
Lai

(10) Patent No.: US 8,087,503 B2
(45) Date of Patent: Jan. 3, 2012

(54) DRIVING MECHANISM AND WHEEL ASSEMBLY FOR TOY CAR

(75) Inventor: Jin-Shi Lai, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 465 days.

(21) Appl. No.: 12/266,503

(22) Filed: Nov. 6, 2008

(65) Prior Publication Data

US 2010/0051403 A1 Mar. 4, 2010

(30) Foreign Application Priority Data

Aug. 28, 2008 (CN) ..... 2008 1 0304257

(51) Int. Cl.
*A63H 29/24* (2006.01)
*F16D 7/04* (2006.01)

(52) U.S. Cl. ..... 192/56.61; 74/411; 446/463; 446/465; 464/39

(58) Field of Classification Search ..... None
See application file for complete search history.

(56) References Cited

U.S. PATENT DOCUMENTS

| | | | | |
|---|---|---|---|---|
| 3,577,747 | A * | 5/1971 | Brown | 464/39 |
| 3,600,847 | A * | 8/1971 | Lakin | 446/164 |
| 6,338,289 | B1 * | 1/2002 | Lee | 74/606 R |
| 6,764,376 | B2 * | 7/2004 | Agostini et al. | 446/466 |
| 7,234,990 | B2 * | 6/2007 | Leonov et al. | 446/440 |
| 2008/0261488 | A1 * | 10/2008 | Jabbour et al. | 446/466 |

* cited by examiner

*Primary Examiner* — David D Le
*Assistant Examiner* — Jacob S Scott
(74) *Attorney, Agent, or Firm* — Altis Law Group, Inc.

(57) ABSTRACT

A driving mechanism for driving a wheel of a toy car includes a motor, a first clutch, a second clutch, a guide shaft, a spring, and a limiting element. The first clutch driven by the motor has an engaging end surface defining a center hole thereon. The second clutch capable of latching with the wheel for driving the wheel has an engaging surface engaging with the engaging end surface. The second clutch defines a stepped hole substantially perpendicular to the engaging surface thereof, the stepped hole includes a first portion and a second portion. The guide shaft is disposed running through the stepped hole and has an end thereof fixed in the center hole. The spring sleeves the guide shaft and is compressed between the limiting element secured on the guide shaft and a stepped surface in the stepped hole.

19 Claims, 3 Drawing Sheets

DRIVING MECHANISM AND WHEEL ASSEMBLY FOR TOY CAR

TECHNICAL FIELD

The present invention relates to toy cars, and particularly to a driving mechanism and wheel assembly for toy car.

DESCRIPTION OF THE RELATED ART

A typical toy car has four wheels including two front wheels and two back wheels. The two front wheels are used for changing the direction of the toy car, and the two back wheels are driven by a motor to move the toy car. When movement of the back wheels are inhibited, the motor for driving thereof may be stopped correspondingly. However, the motor is still supplied with power, thereby, the coil assembly of the motor may be burned.

What is needed, therefore, is a driving mechanism and wheel assembly for toy car to overcome the above-described problem.

BRIEF DESCRIPTION OF THE DRAWINGS

Many aspects of the present driving mechanism and wheel assembly for toy car can be better understood with references to the accompanying drawings. The components in the drawing are not necessarily drawn to scale, the emphasis instead being placed upon clearly illustrating the principles of the present driving mechanism and wheel assembly for toy car.

DETAILED DESCRIPTION OF THE EMBODIMENTS

Embodiments of the present invention will now be described in detail below, with references to the accompanying drawings.

Figure 1:
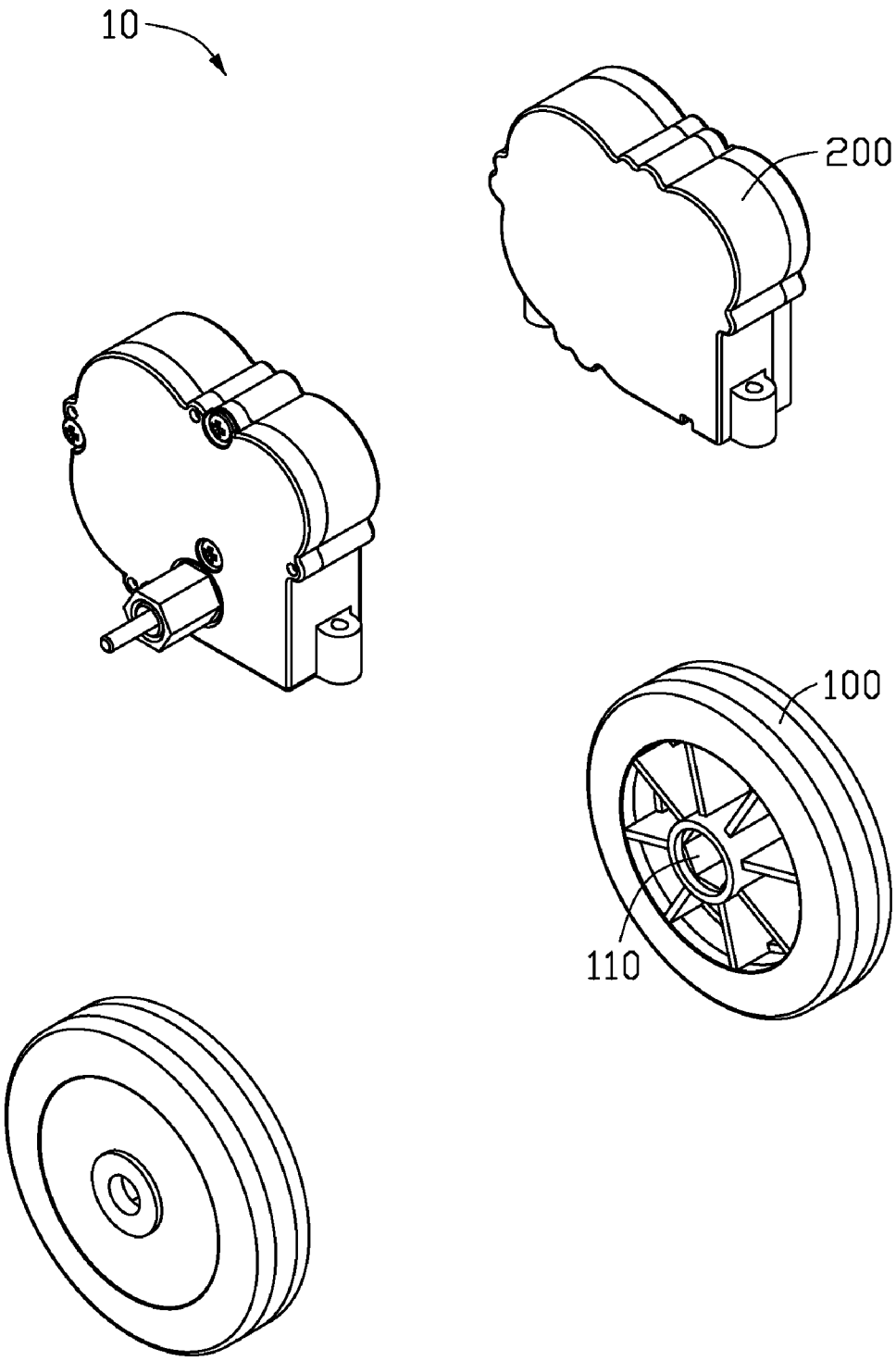
FIG. 1 is a schematic, partially exploded view of a wheel assembly including two wheels and two driving mechanism according to a first exemplary embodiment.
Figure 2:
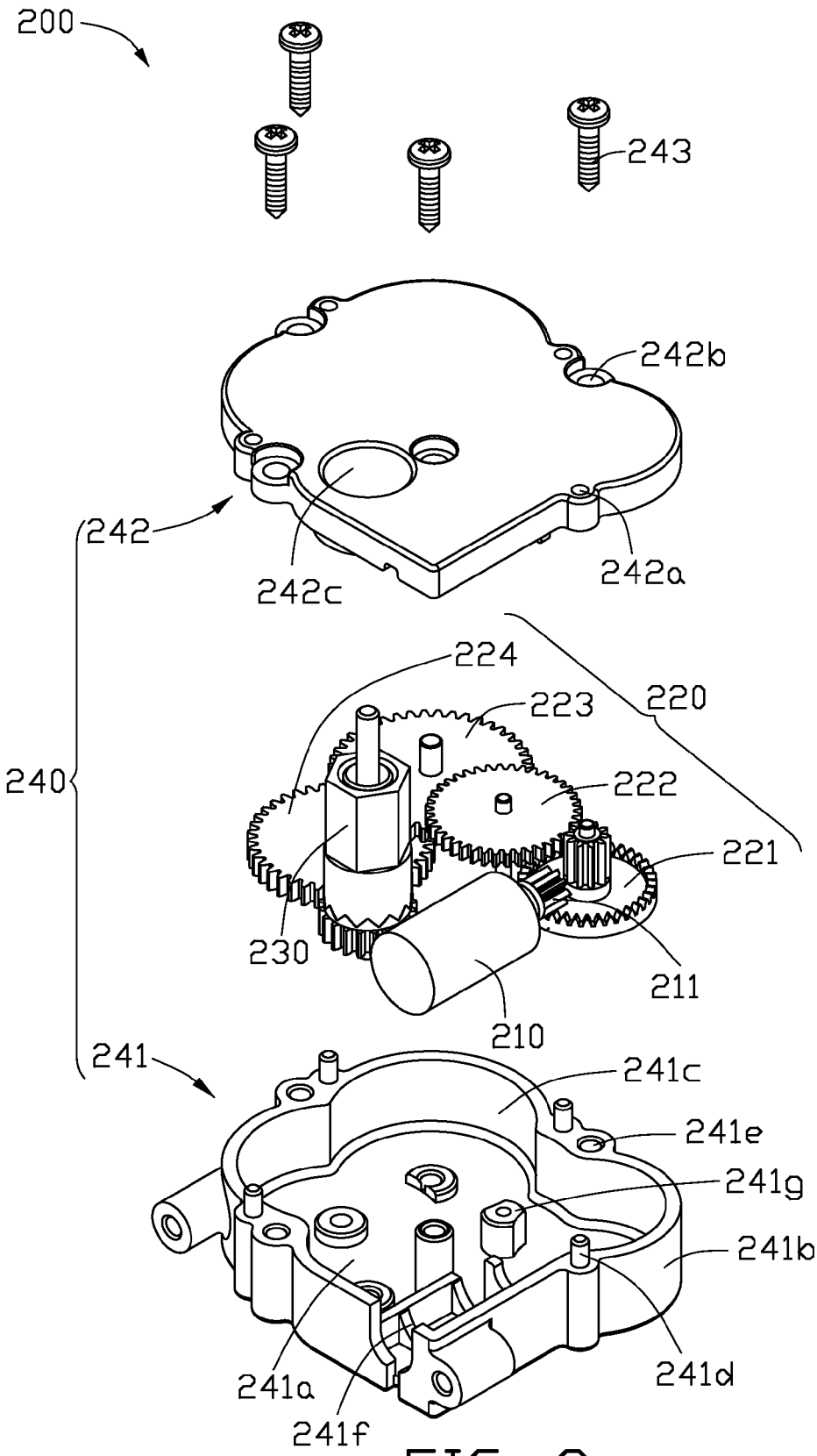
FIG. 2 is an exploded view of the driving mechanism of the wheel assembly of FIG. 1.

Referring to FIGS. 1 and 2, a wheel assembly 10 for a toy car according to a first exemplary embodiment is shown. The wheel assembly 10 includes two wheels 100 and two driving mechanisms 200 for driving the two wheels 100 respectively. The two wheels 100 are assembled on the toy car substantially coaxially.

The driving mechanism 200 includes a motor 210, a number of transmission gears 220, a clutch section 230, and a casing 240. The casing 240 receives the motor 210, the transmission gears 220, and a part of the clutch section 230 therein.

In the present embodiment, the casing 240 includes a receiving portion 241 and a cover 242.

The receiving portion 241 includes a bottom board 241*a* and a side wall 241*b* substantially perpendicularly extending from the bottom board 241*a* and surrounding the bottom board 241*a*. The bottom board 241*a* cooperates with the side wall 241*b* and defines a receiving space 241*c* for receiving the motor 210, the transmission gears 220, and a part of the clutch section 230. The end surface of the side wall 241*b* away from the bottom board 241*a* has a number of guide post 241*d* and defines a number of screw holes 241*e*. A bracket 241*f* and a number of bushings 241*g* are fixed on the bottom board 241*a* and received in the receiving space 241*c*. The bracket 241*f* is configured for mounting the motor 210, and the bushings 241*g* are configured for receiving rotating shafts of the transmission gears 220 and the clutch section 230.

The cover 242 defines a number of guiding holes 242*a* corresponding to the guide post 241*d*, and a number of screw holes 242*b* corresponding to the screw holes 241*e*. The cover 242 also defines an opening 242*c* permitting a part of the clutch section 230 extending out from the casing 240. The receiving portion 241 and the cover 242 are fixed together by a number of screws 243 engaging with the screw holes 242*b* and the screw holes 241*c*.

In the present embodiment, the motor 210 is mounted on the bracket 241*f* of the casing 240 and with the rotating axis thereof substantially parallel to the bottom board 241*a*. A motor gear 211 is connected to the motor 210 and rotatable by the motor 210.

The transmission gears 220 are disposed in the casing 240 with their rotating axis substantially perpendicular to the bottom board 241*a*. Because the length of the motor 210 is relatively longer than the diameter and the thickness of the transmission gears 220 are relative small compared to the diameter, by locating the motor 210 with the rotating axis thereof substantially parallel to the bottom board 241*a*, and the transmission gears 220 with the rotating axis thereof substantially perpendicular to the bottom board 241*a*, the receiving space 241*c* of the casing 240 can be used efficiently and the volume of the casing 240 can be decreased. In the present embodiment, the transmission gears 220 are reduction gears and include a first gear 221, a second gear 222, a third gear 223, and a fourth gear 224 meshed in sequence. The first gear 221 meshes with the motor gear 211 rotatable by the motor 210.

Figure 3:
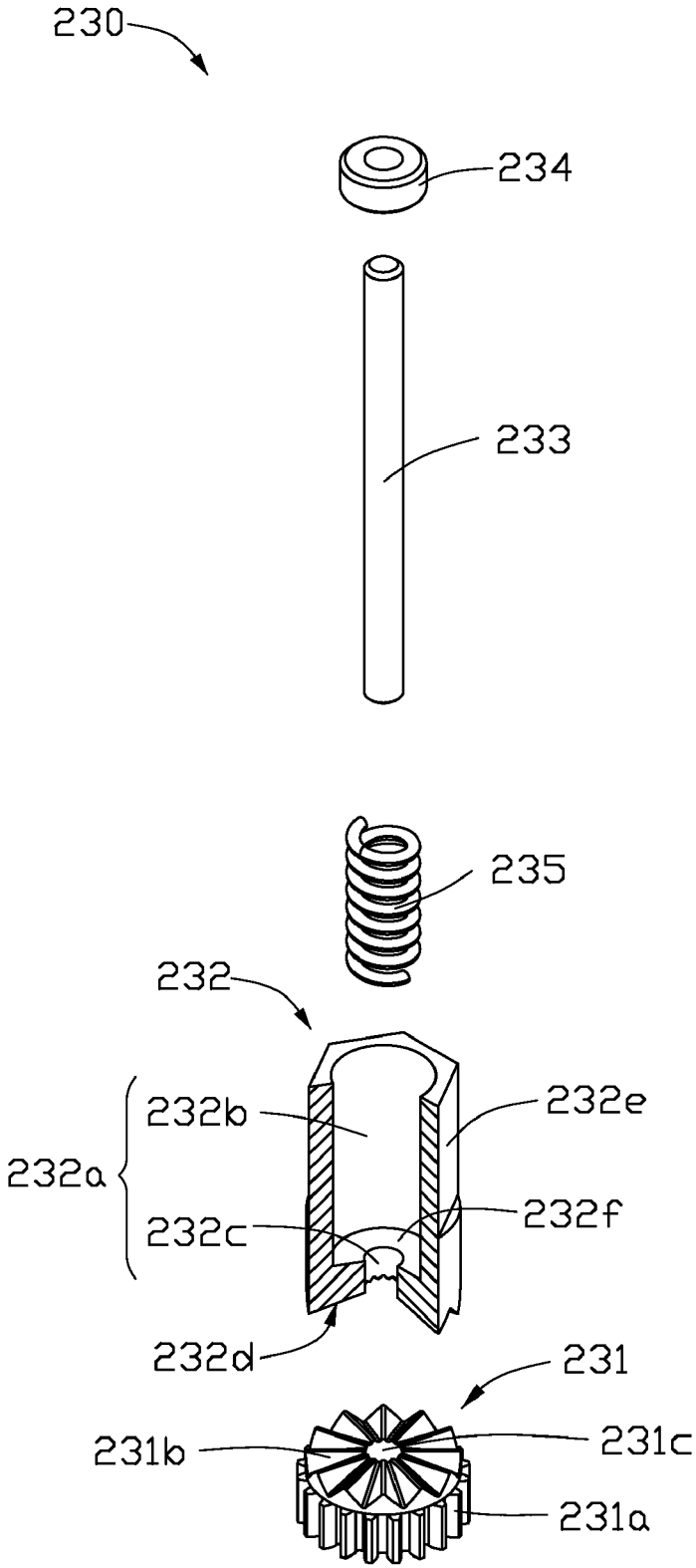
FIG. 3 is an exploded schematic view of a clutch assembly of the driving mechanism of FIG. 2.

Referring to FIG. 3, the clutch section 230 includes a first clutch 231, a second clutch 232, a guide shaft 233, a limiting ring 234, and a spring 235.

The first clutch 231 is a cylinder having a toothed circumference surface 231*a*, for meshing with the fourth gear 224, and an engaging end surface 231*b*. The first clutch 231 defines a center hole 231*c* capable of fixing an end of the guide shaft 233. In the present embodiment, the end surface 231*b* has a number of teeth extending from the edge of the center hole 231*c* along the radial direction thereof.

The second clutch 232 includes a toothed end surface 232*d* capable of meshing with the engaging end surface 231*b* and defines a stepped hole 232*a* running through the second clutch 232. The axis of the stepped hole 232*a* is perpendicular to the end surface 232*d*. The stepped hole 232*a* includes a guiding hole 232*c* and a receiving hole 232*b* along a direction away from the end surface 232*d*. The diameter of the guiding hole 232*c* is smaller than that of the receiving hole 232*b* to form a stepped surface 232*f* between the guiding hole 232*c* and the receiving hole 232*b*. The second clutch 232 has a latching portion 232*e* away from the end surface 232*d*. When the clutch is assembled in the casing 240, the second clutch 232 extends out of the casing 240 from the opening 242*c*. The latching portion 232*e* is configured for latching with the wheel 100. In the present embodiment, the radial cross section of the latching portion 232*e* is a polygon. The wheel 100 has a center hole 110 which radial cross section is a polygonal for latching with the latching portion 232*e*, in order that the wheel 100 rotates with the second clutch 232.

The guide shaft 233 is disposed through the stepped hole 232*a* of the second clutch 232 and having an end thereof fixed in the center hole 231*c* of the first clutch 231. The diameter of the guide shaft 233 is equal to or smaller than that of the guiding hole 232*c* of the second clutch 232, so that, the second clutch 232 can slide along the guide shaft 233. The spring 235 sleeves the guide shaft 233 and is received in the receiving hole 232*b* of the second clutch 232. The outer diameter of the spring 235 is bigger than that of the guiding hole 232*c*. The limiting ring 234 sleeves the guide shaft 233 and is fixed on the guide shaft 233. The diameter of the limiting ring 234 is bigger than the inner diameter of the spring 235. The spring 235 is compressed between the limiting ring 234 and the stepped surface 232*f* of the stepped hole 232*a*.

Normally, the wheel 100 rotates together with the second clutch 232 when the motor 210 is operating, because the engaging surface 231*b* of the first clutch 231 and the engaging surface 232*d* of the second clutch 232 are pushed against each other by the elastic force of the compressed spring 235. However, when rotational movement of the wheel 10 is inhibited, the teeth on the engaging surface 231*b* disengages from the engaging surface 232*d* and the first clutch 231 is able to rotate separately from the second clutch 232, thereby preventing the motor 210 from burning up.

While certain embodiments have been described and exemplified above, various other embodiments will be apparent to those skilled in the art from the foregoing disclosure. The present invention is not limited to the particular embodiments described and exemplified, and the embodiments are capable of considerable variation and modification without departure from the scope of the appended claims.

What is claimed is:

1. A clutch assembly connected between a motor and a wheel for a toy, the clutch assembly comprising:

a first clutch driven by the motor and comprising an engaging end surface defining a center hole thereon;

a second clutch comprising an engaging surface capable of detachably engaging with the engaging end surface of the first clutch, and a latching portion away from the engaging surface for latching with the wheel, wherein the latching portion comprises a non-circular radial cross section;

a guide shaft, a spring, and a limiting element, wherein the second clutch further defining a stepped hole running through the second clutch with the axis thereof substantially perpendicular to the engaging surface thereof, the stepped hole comprising a first portion, a second portion along a direction away from the engaging surface and a stepped surface defined between the first portion and second portion; the guide shaft is disposed through the stepped hole and having an end thereof fixed in the center hole of the first clutch; the spring is sleeved on the guide shaft and being received in the second portion; the limiting element secured on the guide shaft and keeping the spring compressed between the limiting element and the stepped surface in the stepped hole; and a casing defining a receiving space for receiving the motor and the first clutch, and an opening permitting the second clutch to project out of the casing.

2. The clutch assembly according to claim 1, wherein the outer diameter of the spring is bigger than the diameter of the first portion and smaller than the diameter of the second portion, the inner diameter of the spring is bigger than the diameter of the guide shaft and smaller than the outer diameter of the limiting element.

3. The clutch assembly according to claim 1, wherein the casing comprises a receiving portion and a cover, the receiving portion comprises a bottom board and a sidewall substantially perpendicularly extending from the bottom board and surrounding the bottom board, the bottom board cooperates with the side wall to define the receiving space, the cover defines the opening permitting the second clutch to project out of the casing.

4. The clutch assembly according to claim 1, wherein the non-circular radial cross section is a polygon.

5. A driving mechanism for driving a wheel of a toy car comprising:

a motor;

a first clutch driven by the motor, the first clutch comprising an engaging end surface defining a center hole thereon;

a second clutch capable of latching with the wheel for driving the wheel, the second clutch comprising an engaging surface capable of engaging with the engaging end surface of the first clutch, the second clutch defining a stepped hole running through the second clutch with the axis thereof substantially perpendicular to the engaging surface thereof, the stepped hole comprising a first portion, a second portion along a direction away from the engaging surface and a stepped surface defined between the first portion and second portion;

a guide shaft disposed through the stepped hole and having an end thereof fixed in the center hole of the first clutch;

a spring sleeved on the guide shaft and being received in the second portion;

a limiting element secured on the guide shaft and keeping the spring compressed between the limiting element and the stepped surface in the stepped hole; and a casing defining a receiving space for receiving the motor and the first clutch, and an opening permitting the second clutch to project out of the casing;

wherein the second clutch has a latching portion away from the engaging surface thereof for latching with the wheel, and a radial cross section of the latching portion is a polygon.

6. The driving mechanism as claimed in claim 5, wherein the engaging end surface of the first clutch has a plurality of teeth extending from the edge of the center hole along a radial direction thereof.

7. The driving mechanism as claimed in claim 5, wherein the outer diameter of the spring is bigger than the diameter of the first portion and smaller than the diameter of the second portion, the inner diameter of the spring is bigger than the diameter of the guide shaft and smaller than the outer diameter of the limiting element.

8. The driving mechanism as claimed in claim 5, wherein the casing comprises a receiving portion and a cover, the receiving portion comprising a bottom board and a sidewall substantially perpendicularly extending from the bottom board and surrounding the bottom board, the bottom board cooperating with the side wall to define the receiving space, the cover defines the opening.

9. The driving mechanism as claimed in claim 8, further comprising a plurality of transmission gears received in the receiving space of the casing for transmitting a driving force from the motor to the first clutch.

10. The driving mechanism as claimed in claim 9, wherein the transmission gears are reduction gears.

11. The driving mechanism as claimed in claim 9, wherein the motor is located with the rotating axis thereof substantially parallel to the bottom board, and the transmission gears are located with the rotating axis thereof substantially perpendicular to the bottom board.

12. The driving mechanism as claimed in claim 9, wherein the casing comprises a bracket for securing the motor and a plurality of bushings for receiving rotating shafts of the transmission gears.

13. A wheel assembly for a toy car comprising:

a plurality of wheels; and at least two driving mechanisms for driving at least two wheels of the plurality of wheels respectively, each driving mechanism comprising:

a motor;

a first clutch driven by the motor, the first clutch comprising an engaging end surface defining a center hole thereon;

a second clutch capable of latching with the wheel for driving the wheel, the second clutch comprising an engaging surface capable of engaging with the engaging end surface of the first clutch, the second clutch defines a stepped hole running through the second clutch with the axis thereof substantially perpendicular to the engaging surface thereof, the stepped hole comprising a first portion and a second portion along a direction away from the engaging surface and a stepped surface defined between the first portion and second portion;

a guide shaft disposed through the stepped hole and having an end thereof fixed in the center hole of the first clutch;

a spring sleeved on the guide shaft and being received in the second portion;

a limiting element secured on the guide shaft and keeping the spring compressed between the limiting element and a stepped surface in the stepped hole; and a casing defining a receiving space for receiving the motor and the first clutch, and an opening permitting the second clutch to project out of the casing;

wherein the second clutch has a latching portion away from the engaging surface thereof, and the wheel defines a center hole for latching with the latching portion, and a radial cross section of the latching portion is a polygon.

14. The wheel assembly as claimed in claim 13, wherein the engaging end surface of the first clutch has a plurality of teeth extending from the edge of the center hole along a radial direction thereof.

15. The wheel assembly as claimed in claim 13, wherein the outer diameter of the spring is bigger than the diameter of the first portion and smaller than the diameter of the second portion, the inner diameter of the spring is bigger than the diameter of the guide shaft and smaller than the outer diameter of the limiting element.

16. The wheel assembly as claimed in claim 13, wherein the casing comprises a receiving portion and a cover, the receiving portion comprises a bottom board and a sidewall substantially perpendicularly extending from the bottom board and surrounding the bottom board, the bottom board cooperates with the side wall to define the receiving space the cover defines the opening permitting the second clutch to project out the casing.

17. The wheel assembly as claimed in claim 16, wherein the driving mechanism further comprises a plurality of transmission gears received in the receiving space of the casing for transmitting a driving force from the motor to the first clutch.

18. The wheel assembly as claimed in claim 17, wherein the motor is located with the rotating axis thereof substantially parallel to the bottom board, and the transmission gears are located with the rotating axis thereof substantially perpendicular to the bottom board.

19. The wheel assembly as claimed in claim 13, wherein the wheel assembly has two driving mechanisms for driving two wheels, and the two wheels are substantially coaxially on the toy car.

* * * * *